United States Patent [19]

Dauber

[11] 4,191,633

[45] Mar. 4, 1980

[54] PROCESS FOR SUPPRESSION OF HYDROGENOLYSIS AND $C_5^+$ LIQUID YIELD LOSS IN A REFORMING UNIT

[75] Inventor: Louis Dauber, Cranford, N.J.

[73] Assignee: Exxon Research & Engineering Co., Florham Park, N.J.

[21] Appl. No.: 923,191

[22] Filed: Jul. 10, 1978

[51] Int. Cl.[2] ..... C10G 35/08

[52] U.S. Cl. ..... 208/65; 208/138; 208/139; 208/140; 252/415

[58] Field of Search ..... 208/65, 138, 139, 140; 252/415

[56] References Cited

U.S. PATENT DOCUMENTS

| | | | |
|---|---|---|---|
| 3,573,199 | 3/1971 | McCoy | 208/65 |
| 3,684,692 | 8/1972 | Keith et al. | 208/65 |
| 3,835,063 | 9/1974 | Davis et al. | 208/140 |
| 3,875,047 | 4/1975 | Dalson et al. | 208/65 |
| 4,125,454 | 11/1978 | Clem et al. | 208/65 |

*Primary Examiner*—C. Davis

*Attorney, Agent, or Firm*—L. A. Proctor

[57] ABSTRACT

In a reforming process wherein a feed naphtha is reformed, with hydrogen, over a reforming catalyst in a process unit, the improvement comprising the addition of infinitesimal, or small amounts of water or hydrogen halide, or both, or substance which can produce in situ water or hydrogen halide, or both, during the reforming operation to displace previously adsorbed sulfur, or to suppress the adsorption of sulfur by the catalyst to control the amount of sulfur added to the catalyst to a minimum effective level. It has been found, in the sequence of regeneration and reactivation, that the ability of a catalyst to operate in a hydrogenolysis mode can be effectively suppressed after the freshly prepared catalyst has been regenerated, and reactivated several times, generally above five times or more, by presulfiding the catalyst by the addition of a minimal amount of sulfur, preferably a maximum of about 0.01 weight percent sulfur on the catalyst. Water is injected to displace excess sulfur from oversulfided catalyst and a water wave will travel downstream from the catalyst of a reactor to either redistribute sulfur to any undersulfided catalysts of other reactors or help purge the excess sulfur from the system in the form of hydrogen sulfide released to and carried by the recycle gas. Preferably, a modified catalyst presulfiding regimen is imposed wherein the amount of sulfur added to a fresh catalyst is progressively, and preferably proportionately reduced from one regeneration, reactivation sequence to the next such that, on and after about the fifth regeneration, and reactivation of the catalyst a maximum of about 0.01 weight percent sulfur is added to the catalyst.

9 Claims, No Drawings

PROCESS FOR SUPPRESSION OF HYDROGENOLYSIS AND $C_5^+$ LIQUID YIELD LOSS IN A REFORMING UNIT

Reforming with hydrogen, or hydroforming, is a well established industrial process employed by the petroleum industry for upgrading virgin or cracked naphthas for the production of high octane products. Noble metal, notably platinum type catalysts are currently employed, reforming being defined as the total effect of the molecular changes, or hydrocarbon reactions, produced by dehydrogenation of cyclohexanes and dehydroisomerization of alkylcyclopentanes to yield aromatics; dehydrogenation of paraffins to yield olefins; dehydrocyclization of paraffins and olefins to yield aromatics; isomerization of n-paraffins; isomerization of alkylcycloparaffins to yield cyclohexanes; isomerization of substituted aromatics; and hydrocracking of paraffins to produce gas and coke, the latter being deposited on the catalyst.

These several reactions are both endothermic and exothermic, the former predominating, particularly in the early stages of reforming with the latter tending to predominate in the latter stages of reforming. In view thereof, it has become the practice to employ a plurality of adiabatic fixed-bed reactors in series with provision for interstage heating of the feed to each of the several reactors. Two major types of reforming are generally practiced in the multi-reactor units, and in all processes the catalyst must be periodically regenerated by burning off the coke in the initial part of the catalyst reactivation sequence; since coke deposition gradually deactivates the catalyst. In a semi-regenerative process, a process of the first type, the entire unit is operated by gradually and progressively increasing the temperature to maintain the activity of the catalyst caused by the coke deposition, until finally the entire unit is shut down for regeneration, and reactivation, of the catalyst. In the second, or cyclic type of process, the reactors are individually isolated, or in effect swung out of line by various piping arrangements, the catalyst is regenerated to remove the coke deposits, and then reactivated while the other reactors of the series remain on stream. A "swing reactor" temporarily replaces a reactor which is removed from the series for regeneration and reactivation of the catalyst, and is then put back in series. In such processes hydrogen is produced in net yield, the product being separated into a $C_5^+$ liquid product, e.g., a $C_5$/430° F. product, and a hydrogen rich gas a portion of which is recycled to the several reactors of the process unit.

Sulfur is present in virtually any reaction mixture reformed in a commercial reforming unit, and there are numerous causes for its presence. Essentially all petroleum naphtha feeds contain sulfur, a well known catalyst poison which can gradually accumulate upon and poison the catalyst. Most of the sulfur, because of this adverse effect, is generally removed from feed naphthas, e.g., by hydrofining or by contact with nickel or cobalt oxide guard chambers, or both. In use of the more recently developed multi-metallic platinum catalysts wherein an additional metal, or metals hydrogenation-dehydrogenation component is added as a promoter to the platinum, it has become essential to reduce the feed sulfur to only a few parts, per million by weight of feed (ppm). For example, in the use of platinum-rhenium catalysts it is generally necessary to reduce the sulfur concentration of the feed well below about 10 ppm, and preferably well below about 2 ppm, to avoid excessive loss of catalyst activity and $C_5^+$ liquid yield.

Despite these efforts, excessive sulfur does occur in the system. This can occur, e.g., due to insufficient hydrofiner capacity, inadequate stripping of hydrogen sulfide from the hydrofined naphtha, recombination of olefins with hydrogen sulfide, through the introduction of diverse refinery feed streams such as a non-hydrofined hydrocrackate, or because of an upset in the reformer feed preparation system. And, of course, excessive sulfur can be introduced by oversulfiding the catalyst which is used in conducting the reforming reaction during the pretreatment sequence before on oil operation.

The role of sulfur on the catalyst, in any event, presents somewhat of an anomaly because the presence of sulfur in the reaction mixture can adversely affect the activity of the catalyst and reduce liquid yield; and yet, sulfiding of the multi-metallic catalyst species, which is a part of the catalyst reactivation procedure, has been found essential to suppress excessive hydrogenolysis which is particularly manifest when a reactor is first put on stream after regeneration and reactivation of the catalyst. Excessive hydrogenolysis caused by use of these highly active catalysts can not only produce acute losses in $C_5^+$ liquid yield through increased gas production, but the severe exotherms which accompany operation in a hydrogenolysis mode can seriously damage the catalyst, reactor, and auxiliary equipment.

In semi-regenerative reforming, it has been found that when a unit comprised of a series of reactors containing highly active rhenium promoted platinum catalysts is put on-stream, albeit the reactors contain regenerated, reactivated, sulfided catalyst, there occurs an initial upset period when the catalyst activity and $C_5^+$ liquid yield of the unit is reduced. A similar effect has been observed in the operation of a cyclic reforming unit. When a reactor, e.g., a swing reactor, containing a freshly regenerated, reactivated presulfided catalyst is reinserted in the multiple reactor series of the unit, it has a quantity of sulfur which is released when the catalyst is contacted with the feed, the sulfur wave travelling downstream from one reactor to the next of the sequence. Concurrent with the sulfur wave there results a temporary loss in $C_5^+$ liquid yield which, like a wave, also progresses in seratim from one reactor of the series to the next until finally the $C_5^+$ liquid yield loss is observed throughout the unit. Other a sufficiently long period after the initial decline in $C_5^+$ liquid yield loss, the $C_5^+$ liquid yield in the several reactors of the unit, and consequently the overall performance of the unit, gradually improves to its original higher performance level. The effect of this phenomenon is that, in the overall operation, the catalyst contained in the several reactors briefly becomes less active, and a transient, but profound $C_5^+$ liquid yield loss is observed. In a semi-regenerative operation the loss is sustained throughout the initial period of operation until the unit has lined-out, which usually occurs after the first several days of operation.

It is, accordingly, the primary object of this invention to provide a new and improved process which will obviate these and other disadvantages of the present start-up procedures for semi-regenerative and cyclic reforming units, particularly those employing highly active promoted noble metal containing catalysts.

A specific object is to provide a new and novel operating procedure for semi-regenerative and cyclic reforming units, notably one which will effectively accelerate sulfur release and shorten the normally expected initial period of $C_5+$ liquid yield decline which occurs with platinum catalysts to which is added a hydrogenation-dehydrogenation component, or components, particularly rhenium, which increases the tendency of the catalyst to operate in the hydrogenolysis mode.

Another object is to provide means for preventing absorption of more than the equilibrium amount of sulfur on catalyst or for rapid desorption of previously adsorbed sulfur.

These objects and others are achieved in accordance with the present invention which comprises a new and improved mode of operating a reforming unit, either a semi-regenerative or cyclic reforming unit, by the addition or injection of small and infinitesimal amounts of water or hydrogen halide, or both, or substance which can produce in situ water or hydrogen halide, or both, during the reforming operation to displace previously adsorbed sulfur, or to suppress the adsorption of sulfur by a catalyst to control the amount of sulfur added to the catalyst to an equilibrium level. It has been found in the sequence of regeneration and reactivation of the catalyst, that the ability of a catalyst to operate in a hydrogenolysis mode and effect sulfur release can be effectively suppressed after the freshly prepared catalyst has been regenerated, and reactivated several times, preferably about five times or more, by presulfiding the catalyst with sulfur to deposit, as hereinafter defined, preferably a maximum of about 0.01 percent sulfur, more preferably from about 0.001 percent to about 0.005 percent sulfur, based on the total weight of the catalyst (dry basis) and that the proper amounts of sulfur can be maintained on the catalyst by the continuous addition or injection of from about 0.5 to about 50 wppm, preferably from about 1 to about 20 wppm water or hydrogen halide, notably hydrogen chloride, or both, into the system. Alternately the equivalent of from about 0.05 to about 0.2 wt. % catalyst of water or halide may be injected. Water and halide should preferably be added simultaneously to prevent unduly disturbing the catalyst halide content. This mode of operation differs profoundly from a prior art operation wherein from about 0.05 percent to about 0.10 percent sulfur, based on the weight of the catalyst, is added to a catalyst to suppress hydrogenolysis, no water is injected, and wherein, when a reactor containing such catalyst is initially put on stream a release of sulfur as hydrogen sulfide in concentration ranging from about 10 to about 20 parts per million parts based on volume (vppm), is released in the recycle gas to poison catalyst dehydrogenation sites, thereby temporarily causing excessive cracking and lowered $C_5+$ liquid yields.

This invention is based on the recognition that, in a cyclic reforming unit, an in situ water wave immediately follows a sulfur wave when a reactor containing a freshly sulfided catalyst is put on-stream, and that a water wave, on contacting a freshly sulfided catalyst, causes release of sulfur from the catalyst. Sulfur release has also been observed in the operation of a semi-regenerative reforming unit by injecting halide and/or water into the system during on-oil operation. It is believed that, initially, the sulfur associates itself with the active sites of a catalyst, but thereafter when the catalyst is contacted by water, the water and sulfur moieties compete with each other for association with the active sites of the catalyst. Concurrent with such consideration, it has also been found, quite surprisingly, that residual sulfur remains on the catalyst even after catalyst regeneration, and reactivation, despite the high temperature burn to which the catalyst is subjected to remove coke deposits.

This phenomenon suggests an unusually high affinity of sulfur for catalyst sites; albeit sulfur is so readily displaced from a freshly regenerated, reactivated catalyst by water. As a consequence, it has been found that far smaller amounts of sulfur than are conventional can be beneficially employed in overall catalyst presulfiding operations, particularly in sulfiding catalysts which have previously been regenerated, and reactivated a number of times. Pre-sulfided catalysts which have been previously regenerated, and reactivated require far less sulfur to maintain an effective sulfide level, and apparently after several regeneration/reactivation sequences of treatment the sulfide level reaches an equilibrium level of from about 0.03 to about 0.4 wt. % sulfur on the catalyst. Thereafter, only minimal sulfur need be added to the system, if any, to maintain the effective sulfide level on the catalysts of the several reactors. Added sulfur can be effectively distributed from the catalyst of any given reactor to the catalysts of other reactors for maintenance purposes by adding sulfur, e.g., as by presulfiding only the catalyst of a selected reactor, or reactors, because sulfur will be carried throughout the reactor system by recycle hydrogen, and sulfur will be adsorbed by the catalysts if they are undersulfided, and in situ water waves or injected water will remove sulfur from oversulfided catalyst and redistribute sulfur to undersulfided catalysts or release it from the catalyst system.

A feature of the invention then also resides in the discovery that even when a reactor containing a freshly prepared catalyst is put on stream benefits can also be derived by use of a modified catalyst presulfiding regimen wherein the amount of sulfur added to the catalyst is progressively, and preferably proportionately reduced from one regeneration, reactivation sequence to the next until such time that an equilibrium amount of residual sulfur has been retained by the catalyst. Preferably on and after about the fifth regeneration, and reactivation sequence, a maximum of about 0.01 percent sulfur, based on the total weight of the catalyst (dry basis), is added to the catalyst. In a preferred sequence of operation, a maximum of from about 0.05 percent to about 0.10 percent sulfur, based on the total weight of the catalyst (dry basis), is added ab initio to the fresh catalyst, the maximum amount of sulfur added to the catalyst being reduced about twenty percent to about forty percent with each regeneration, and reactivation of the catalyst. Thus, e.g., if 0.05 weight percent sulfur is put on the fresh catalyst, about 0.04 weight percent is put on the catalyst after the first regeneration, and reactivation of the catalyst; about 0.03 weight percent is put on the catalyst after the second regeneration and reactivation of the catalyst; about 0.025 weight percent is put on the catalyst after the third regeneration and reactivation of the catalyst; about 0.015 weight percent is put on the catalyst after the fourth regeneration and reactivation of the catalyst; and about 0.01 weight percent is put on the catalyst after the fifth regeneration and reactivation of the catalyst. Similarly, if 0.10 percent weight percent sulfur is put on the fresh catalyst; about 0.08 weight percent sulfur is put on the catalyst after the first regeneration, and reactivation of the catalyst; about 0.06 weight percent sulfur is put on the catalyst after the second regeneration, and reactivation of the catalyst; about 0.04 weight percent sulfur is put on the catalyst after the third regeneration, and reactivation of the catalyst; about 0.02 weight put on the catalyst after the fourth regeneration, and reactivation of the catalyst; and about 0.01 weight put on the catalyst after the fifth regeneration, and reactivation of the catalyst.

In a preferred mode of operation, following an upset which results in introducing a large quantity of sulfur into the system, water is injected with the feed, or gas, or separately injected, for contact with the catalyst to supress adsorption of sulfur or effect release of sulfur in the form of hydrogen sulfide from the catalyst. Organic halides can also be added, to effect sulfur release, and also to increase correspondingly the level of halogen, and maintain the proper catalyst halide level since water will cause a loss of halogen and reduction in the halide level of the catalyst. The released hydrogen sulfide is purged from the system over a period of time via the unit make gas or removed from the recycle gas, or both, by means of desiccants or specific sulfide removal agents, e.g., zinc oxide. Or, if the sulfur content of the naphtha feed is higher than desired in normal operation for any reason, water and halogen can be injected to reduce the sulfur-on-catalyst level and to maintain the desired halide level on the catalyst, thereby obtaining improved catalyst activity and yields. The amount of water and halide injected is increased in proportion to the feed sulfur level. In a cyclic operation, more rapid displacement of presulfiding sulfur can be obtained by controlling the regeneration conditions to produce a higher water and halide level on the catalyst before swinging the reactor back on-stream, or by direct injection of water into the system.

In all embodiments a minimum amount of sulfur, particularly after the sulfide level of the catalysts has equilibrated (which occurs after about the fifth sequence of regeneration and reactivation of a catalyst), is released into the recycle gas of the cyclic system, and consequently less sulfur is available for poisoning the dehydrogenation sites of the catalyst, such that substantially optimal $C_5$+ liquid yield is achieved with smoother operation, and better catalyst utilization.

Water injected into the system, e.g., the lead reactor of the series, passes successively through downstream reactors and displaces sulfur from the catalysts of these reactors, the emitted sulfur emerging as hydrogen sulfide in the recycle gas of which a portion can, if desired, be recycled to the lead reactor, or reactors, of the series to sulfide the unsulfided, or undersulfided catalyst. As the unsulfided, or undersulfided catalyst is sulfided by absorption onto the catalyst, the hydrogen sulfide concentration in the recycle gas passed downstream is decreased. The net effect is that excess, or marginally excess, sulfur on the catalyst of a lead reactor, or reactors, is redistributed to a downstream reactor, or reactors, and the hydrogen sulfide in the recycle gas rapidly lines out, e.g., within only about one hour or less from the time to the upset, or time that a reactor, or reactors containing an unsulfided, or undersulfided catalyst is put on stream, to a base level of less than 1 vppm sulfur in the recycle gas. This is sharply contrasted with conventional presulfiding wherein the catalysts of all of the reactors are sulfided to levels ranging from 0.05 weight percent to 0.10 weight percent, and wherein in a cyclic operation an upset operation of a more extended period is produced before line-out occurs. This extension of the upset periods, of course, results in a significantly greater $C_5$+ liquid yield loss, principally due to $C_3/C_4$ cracking and the elevated system sulfur level.

In many reforming units it is customary to employ recycle gas drying in order to control the moisture level in the gas recirculating to the catalyst. In all embodiments, the off gas from the last reactor of the series, predominantly an admixture of hydrogen and hydrocarbon containing moisture and hydrogen sulfide, is passed through a drier wherein essentially all or a major portion of the moisture is removed, suitably by contact with an adsorbent, after which time the gas is recycled to the process. Preferably, the moisture level of the recycle gas exiting the reactors is maintained below about 50 parts, more preferably below about 20 parts, per million parts of hydrogen. Suitably also, some of the hydrogen sulfide can be removed from the recycle gas should its concentration become excessive. Generally, the hydrogen sulfide level in the recycle gas is maintained below about 10 parts, or more preferably below about 5 parts, per million parts of hydrogen.

Sulfur can also be introduced into the system through the hydrocarbon feed, and consequently the feed sulfur level is normally maintained at very low level. On the other hand, where the sulfur level of the catalyst of the several reactors of a unit have already substantially equilibrated, or reached an equilibrium sulfur level, a major portion of the sulfur required to maintain an equilibrium amount thereof on the catalyst of the several reactors can be added to the feed, i.e., to make up for small loss of sulfur during regeneration.

The invention, and its principle of operation, will be more fully understood by reference to the following examples, and comparative data which characterized a preferred mode of operation.

EXAMPLE 1

In an operating unit utilizing a platinum-rhenium (Pt/Re) catalyst, feed sulfur had been elevated above the maximum desirable level due to operating problems in the feed preparation section. Hence, recycle gas $H_2S$ concentration was too high and ranged from 2.7 to 3.4 vppm. After the feed problem was alleviated, it was desired to return the catalyst to its normal state by removal of excess sulfur as rapidly as possible. Accordingly, a "pulse" of water was introduced into the system via the feed, the feed water level being increased to approximately 50 wppm for about a 2 hour period. The hydrogen sulfide concentration in the recycle gas was immediately noticed to increase to 5.3 wppm from a base level of 2.5 wppm in the preceding hours, demonstrating desorption of excess sulfur from the catalyst. Over the next 12 hours, as the catalyst dried down, the hydrogen sulfide concentration declined and leveled out at 1.6 wppm. It was then found possible to resume normal operations.

EXAMPLE 2

The following test operation was conducted in a cyclic operating unit with a Pt/Re catalyst; the lead reactor catalyst was regenerated, rejuvenated, and the catalyst thereof reduced by treatment with hydrogen in preparation for reinsertion into the reaction circuit. The catalyst was not presulfided, however, the catalyst was equilibrated with a moist gas containing about 8,000 vppm water at 850° F. and 125 psig during the regeneration procedure. The hydrogen sulfide level of the recycle gas had been lined out at 1 vppm. The recycle gas drier was temporarily bypassed.

As soon as the reactor containing the freshly regenerated, reactivated catalyst was introduced into the reaction circuit, a wave of water traveled through the downstream reactors. This resulted in desorption of sulfur; the hydrogen sulfide concentration immediately rising above 10 vppm (the upper limit of the on stream analyzer). The recycling hydrogen sulfide sulfided the fresh catalyst of the lead reactor, and no exotherms were observed. The excess hydrogen sulfide which was released was gradually purged from the system via the make gas. The hydrogen sulfide analyzer returned to an on-scale reading of less than 10 vppm after 2 hours; the prereactor swing hydrogen sulfide level of 1 vppm was obtained after another 5 hours. Although the recycle gas drier was not inserted following the swing in order to evaluate hydrogen sulfide release dynamics, it could normally be put on stream to help absorb the hydrogen sulfide from the recycle gas, thus considerably accelerating the lineout period.

EXAMPLE 3

In a semi-regenerative reformer loaded with a bimetallic platinum-iridium (Pt/Ir) catalyst the catalyst had been too heavily sulfided prior to oil-in and during early operations. Catalyst activity was below par and little improvement was apparent. It was believed that the catalyst was also somewhat deficient in chloride. In view of this deficiency, it was decided to "pulse" the equivalent of 0.3 wt. % chloride to the last reactor; this simultaneously improved catalyst chloride level and reduced its sulfur level. At the same time, t-butyl alcohol was added to the feed in order to redistribute the chloride over the catalyst of all the catalyst beds and further assist in sulfur desorption. The chloride was added in the form of trichlorethylene in seven separate pulses over a two-day period. The following table shows the results of this procedure:

| | Before TCE/Alcohol | After Addition |
|---|---|---|
| Feed Gravity | 58.8 | 58.0 |
| IBP/EBP, °F. | 180/362 | 184/344 |
| W/H/W | 3.3 | 3.4 |
| Avg. Temperature, °F. | 933 | 930 |
| Reformate RON | 95.5 | 98.0 |
| ReactorΔT's, °F. | | |
| A | 105 | 110 |
| B | 28 | 39 |
| C | 5 | 10 |
| Total | 138 | 159 |
| Mol% $H_2$in Recycle Gas | 62.5 | 69.0 |
| Relative Activity Index | 100 | 142 |

During the addition of the chloride, the hydrogen sulfide concentration in the stabilizer off gas rose from 2 to 18 vppm and then declined again to 2 vppm.

It was noted that all the common criteria used for evaluating reforming catalyst activity and selectivity showed improvement, i.e., the recycle gas purity, reactor ΔT's, and the overall activity index (based on octane severity, feed characteristics, operating conditions). Although higher chloride on catalyst can partly explain the higher activity, only a reduction in catalyst sulfur can explain the overall performance improvement of the catalyst.

It is apparent that the present invention is subject to various modifications and changes without departing the spirit and scope thereof.

The present invention finds its greatest utility in cyclic reforming processes wherein the new "bimetallic" or multi-metallic catalysts are employed, notably Group VIII platinum group, or noble metals (ruthenium, rhodium, palladium, osmium, iridium and platinum), e.g., platinum-rhenium, platinum-rhenium-iridium, palladium-rhenium, platinum-palladium-rhenium, etc. Fresh, or reactivated catalysts of this type are particularly hypersensitive. Exotherms or heat fronts can be produced which pass through a catalyst bed at startup, i.e., when new or freshly regenerated catalyst is initially contacted with hydrocarbons at reforming temperatures. The temperature excursions or heat fronts are attributed to the hyperactivity of the catalyst which causes excessive hydrocracking of the hydrocarbons or hydrogenolysis, sometimes referred to as "runaway hydrocracking." These temperature excursions or heat fronts are undesirable because the resultant temperature often results in damage to the catalyst, or causes excessive coke laydown on the catalyst with consequent catalyst deactivation and, if uncontrolled, may even lead to damage to the reactor and reactor internals. The present invention serves to suppress, or even eliminate this severe hydrocracking problem.

Other catalysts suitable for the practice of this invention contain a hydrogenation-dehydrogenation component constituted of a platinum group metal, or admixtures of these and/or one or more additional non-platinum group metallic components such as germanium, gallium, tin, rhenium, tungsten, and the like. A preferred type of catalyst contains the hydrogenation-dehydrogenation component in concentration ranging from about 0.01 to about 5 wt. %, and preferably from about 0.2 to about 1.0 wt. %, based on the total catalyst composition. In addition, such catalysts also usually contain an acid component, preferably halogen, particularly chlorine or fluorine, in concentration ranging from about 0.1 to about 5 wt. %, and preferably from about 0.3 to about 1.0 wt. %. The hydrogenation-dehydrogenation components are composited with an inorganic oxide support, such as silica, silica-alumina, magnesia, thoria, zirconia, or the like, and preferably alumina.

Methods of regeneration, and reactivation of these catalysts are known and per se form no part of the present invention. Conventionally, an isolated reactor which contains a bed of catalyst, the latter having reached an objectionable degree of deactivation due to coke deposition thereon, is first purged of hydrocarbon vapors with a nonreactive or inert gas, e.g., helium, nitrogen, or flue gas. The coke or carbonaceous deposits are then burned from the catalyst by contact with an oxygen-containing gas at controlled temperature below the sintering point of the catalyst, generally below about 1300° F., and preferably below about 1200° F. The temperature of the burn is controlled by controlling the oxygen concentration and inlet gas temperature, this taking into consideration, of course, the amount of coke to be burned and the time desired in order to complete the burn. Typically, the catalyst is treated with a gas having an oxygen partial pressure of at least about 0.1 psi (pounds per square inch), and preferably in the range of about 0.3 psi to about 2.0 psi to provide a temperature ranging from 575° F. to about 1000° F., at static or dynamic conditions, preferably the latter, for a time sufficient to remove the coke deposits. Coke burn-off can be accomplished by first introducing only enough oxygen to initiate the burn while maintaining a temperature on the low side of this range, and gradually increasing the temperature as the flame front is advanced by additional oxygen injection until the temperature has reached optimum. Most of the coke can be readily removed in this way.

Typically in reactivating multimetallic catalysts, sequential halogenation and hydrogen reduction treatment are required to reactivate the reforming catalysts to their original state of activity, or activity approaching that of fresh catalyst after coke or carbonaceous deposits have been removed from the catalyst. Suitably, the coke is burned from the catalyst, initially by contact thereof with an admixture of air and flue gas or nitrogen to give about 0.75 wt. percent oxygen at temperatures ranging to about 750° F., and thereafter the oxygen is increased within the mixture to about 6 wt. percent and the temperature gradually elevated to about 950° F.

The agglomerated metals of the catalyst are redispersed and the catalyst reactivated by contact of the catalyst with halogen, suitably a halogen gas or a substance which will decompose in situ to generate halogen. Various procedures are available dependent to a large extent on the nature of the catalyst employed. Typically, e.g., in the reactivation of a platinum-rhenium catalyst, the halogenation step is carried out by injecting halogen, e.g., chlorine, bromine, fluorine or iodine, or a halogen component which will decompose in situ and liberate halogen, e.g., carbon tetrachloride, in the desired quantities, into the reaction zone. The gas is generally introduced as halogen, or halogen-containing gaseous mixture, into the reforming zone and into contact with the catalyst at temperature ranging from about 550° F. to about 1150° F., and preferably from about 700° F. to about 1000° F. The introduction may be continued up to the point of halogen breakthrough, or point in time when halogen is emitted from the bed downstream of the location of entry where the halogen gas is introduced. The concentration of halogen is not critical, and can range, e.g., from a few parts per million (ppm) to essentially pure halogen gas. Suitably, the halogen, e.g., chlorine, is introduced in a gaseous mixture wherein the halogen is contained in concentration ranging from about 0.01 mole percent to about 10 mole percent, and preferably from about 0.1 mole percent to about 3 mole percent.

After dispersing the metals with the halogen treatment, the catalyst can then be rejuvenated by soaking in an admixture of air which contains about 6 wt. percent oxygen, at temperatures ranging from about 850° F. to about 950° F.

Oxygen is then purged from the reaction zone by introduction of a nonreactive or inert gas, e.g., nitrogen, helium or flue gas, to eliminate the hazard of a chance explosive combination of hydrogen and oxygen. A reducing gas, preferably hydrogen or a hydrogen-containing gas generated in situ or ex situ, is then introduced into the reaction zone and contacted with the catalyst at temperatures ranging from about 400° F. to about 1100° F., and preferably from about 650° F. to about 950° F., to effect reduction of the metal hydrogenation-dehydrogenation components, contained on the catalysts. Pressures are not critical, but typically range between about 5 psig to about 300 psig. Suitably, the gas employed comprises from about 0.5 to about 50 percent hydrogen, with the balance of the gas being substantially nonreactive or inert. Pure, or essentially pure, hydrogen is, of course, suitable but is quite expensive and therefore need not be used. The concentration of the hydrogen in the treating gas and the necessary duration of such treatment, and temperature of treatment, are interrelated, but generally the time of treating the catalyst with a gaseous mixture such as described ranges from about 0.1 hour to about 48 hours, and preferably from about 0.5 hour to about 24 hours, at the more preferred temperatures.

The catalyst of a reactor may be presulfided, prior to return of the reactor to service. Suitably a carrier gas, e.g., nitrogen, hydrogen, or admixture thereof, containing from about 500 to about 200 ppm of hydrogen sulfide, or compound, e.g., a mercaptan, which will decompose in situ to form hydrogen sulfide, at from about 700° F. to about 950° F., is contacted with the catalyst for a time sufficient to incorporate the desired amount of sulfur upon the catalyst.

Having described the invention what is claimed is:

1. In a process for reforming, with hydrogen, a naphtha feed in a reforming unit which contains a plurality of catalyst-containing on-stream reactors connected in series, the hydrogen and naphtha feed flowing from one reactor of the series to another to contact the catalyst contained therein at reforming conditions, the improvement comprising adding a maximum of about 0.01 percent sulfur, based on the total weight of the catalyst, to the catalyst of a reactor after the freshly prepared catalyst has been regenerated and reactivated about five times, or more, and injecting water into an on-line reactor of the series in concentration ranging from about 0.5 to about 50 wppm, based on feed, to maintain and control the sulfur level of the ctalyst.

2. The process of claim 1 wherein the water is injected after about the fifth regeneration/reactivation sequence in concentration ranging from about 1 to about 20 wppm, based on feed.

3. The process of claim 1 wherein sulfur is added to the catalysts during about the first five catalyst regeneration/reactivation sequences, the sulfur added to the catalyst being progressively reduced between the first catalyst regeneration/reactivation sequence and about the fifth at which time the sulfided catalyst contains a maximum of about 0.01 percent sulfur.

4. The process of claim 1 wherein the catalysts are platinum catalyts promoted with a hydrogenation-dehydrogenation component, or components, which increase the rate of hydrogenolysis as contrasted with an unpromoted platinum catalyst.

5. The process of claim 4 wherein the platinum catalyst is promoted with rhenium.

6. In a process for reforming, with hydrogen, a naphtha feed in a reforming unit which contains a plurality of catalyst-containing on-stream reactors connected in series, the catalyst is a platinum catalyst promoted with a hydrogenation-dehydrogenation component, or components, which increase the rate of hydrogenolysis as contrasted with an unpromoted platinum catalyst, the hydrogen and naphtha feed flows from one reactor of the series to another to contact the catalyst contained therein at reforming conditions, the improvement comprising adding a maximum of about 0.01 percent sulfur to the catalyst of a reactor after about the fifth sequence of regeneration and reactivation of the freshly prepared catalyst, injecting water into an on-line reactor of the series of concentration ranging from about 0.5 to about 50 wppm, based on feed, to maintain and control the sulfur level of the catalyst.

7. The process of claim 6 wherein the platinum catalyst is promoted with rhenium.

8. The process of claim 6 wherein a maximum of about 0.001 percent to about 0.005 percent sulfur is added to the catalyst after about the fifth sequence of regeneration and reactivation.

9. The process of claim 6 wherein the equivalent 0.05 to 0.2 wt. % on catalyst of halide and proportionate amounts of water are injected over short term periods to rapidly remove excess sulfur from the catalyst.

* * * * *